US006267164B1

(12) United States Patent
Carpenter

(10) Patent No.: US 6,267,164 B1
(45) Date of Patent: Jul. 31, 2001

(54) CHIP AND METHOD FOR THE PRODUCTION OF WOOD PULP

(75) Inventor: Charles Thomas Carpenter, Lake Oswego, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 09/181,035

(22) Filed: Oct. 27, 1998

(51) Int. Cl.[7] ..... B27L 11/00

(52) U.S. Cl. ..... 144/373; 144/176; 144/363; 241/92; 428/107; 428/113

(58) Field of Search ..... 144/162.1, 172, 144/173, 174, 176, 363, 369, 373; 241/92, 189.1, 274, 298, 292.1; 428/106, 107, 113, 311.7, 191

(56) References Cited

U.S. PATENT DOCUMENTS

| | | | | |
|---|---|---|---|---|
| 2,585,673 | | 2/1952 | Ottersland . | |
| 3,304,970 | | 2/1967 | Altosaar . | |
| 3,486,541 | | 12/1969 | Nilsson . | |
| 3,627,005 | | 12/1971 | Morton et al. . | |
| 3,670,791 | * | 6/1972 | Johnson | 144/176 |
| 3,777,793 | | 12/1973 | Miller . | |
| 3,780,778 | | 12/1973 | Chapman . | |
| 4,082,127 | | 4/1978 | Miller . | |
| 4,139,034 | | 2/1979 | Chapman . | |
| 4,346,744 | | 8/1982 | Beer et al. . | |
| 4,346,745 | | 8/1982 | Weavell et al. . | |
| 4,569,380 | * | 2/1986 | Amasmith | 144/176 |
| 4,685,497 | | 8/1987 | Mierau et al. . | |
| 4,865,094 | | 9/1989 | Stroud et al. . | |
| 5,313,696 | | 5/1994 | Dunne et al. . | |
| 5,485,873 | | 1/1996 | Crammond . | |
| 5,782,278 | | 7/1998 | Larsson . | |

* cited by examiner

*Primary Examiner*—W. Donald Bray
(74) *Attorney, Agent, or Firm*—Birdwell & Janke, LLP

(57) ABSTRACT

A chip and method for producing wood pulp. First, second and third pairs of substantially parallel sides are formed by cleaving, cutting and cutting, respectively. The sides of the second pair of sides are cut by a first knife so as to be spaced between about 2 to 8 mm. The sides of the third pair of sides are cut by a second knife so as to be spaced a greater distance apart than the first pair. The sides of the first pair of sides are cleaved substantially along the grain direction so as to be spaced also a greater distance apart than the sides of the first pair. The sides of the third pair of sides are cut so as to be substantially perpendicular to the sides of the first pair of sides.

10 Claims, 2 Drawing Sheets

CHIP AND METHOD FOR THE PRODUCTION OF WOOD PULP

BACKGROUND OF THE INVENTION

The present invention relates to a chip and method for the production of wood pulp, especially for the production of paper.

Wood chips for the pulp and paper industry have been produced for years from equipment known in the art as "chippers" or, occasionally, "choppers." This equipment employs a knife for cutting repeatedly into a log or other bulk piece of wood to produce chips having relatively small dimensions of length, width and thickness.

The chips are processed by "cooking" them in a digester at temperatures of about 170–180 degrees centigrade in a sodium hydroxide or sodium bisulfide "liquor" to dissolve the lignins and other binders in the chips and leave behind the cellulose fibers. The liquor diffuses into the chips at a predetermined rate.

It has been estimated that an increase in digester yield of just 1% provides a savings of about $1 million per year per digester. This yield is determined by a number of factors. One of these is chip uniformity. Uniform chip shapes and sizes provide for greater packing density. In the digester, this provides a greater amount of cellulose from a given batch of chips. Uniform chip thickness is particularly important to digester yield. This dimension is smaller than the length and width of the chips, and controls the time required for the liquor to diffuse sufficiently into the chip to dissolve the lignin. Chips that are thicker than the target thickness spend too little time in the digester for removal of all of the lignin, and chips that are thinner than the target thickness are overcooked in the digester so that the liquor attacks and degrades the cellulose fibers themselves.

The absolute shape and size of the chips are also important factors in the efficient conversion of wood chips to cellulose. It is desirable that the chips be thin to minimize the difference in time that fibers in the interior of the chip and fibers on the exterior of the chip are cooked. On the other hand, chipping the wood so as to produce very thin chips mechanically damages a greater percentage of the total fiber in the chips. Accordingly, there has been determined in the pulping industry an acceptable chip thickness lying within the range of about 1 mm to about 8–10 mm, with the optimum chip thickness being about 4–5 mm.

Chip shape is also an important contributor to efficient cellulose production. Conventional chip shapes result from forming processes that bruise and damage the wood fibers. As a response to this problem, Altosaar, U.S. Pat. No. 3,304,970 proposes a chip and process for forming the chip wherein the main or larger faces of the chip are produced by cutting substantially parallel to the grain while the two side edges are cut across and at an angle to the grain, with the remaining end surfaces being formed by splitting or cleaving along the grain. However, in cutting the wood across the grain at an angle to form the side edges, an increased cut surface area results. In contrast with cleaving the wood along the grain, cutting the fibers damages the ends thereof, and cutting them at an angle exposes more of the fibers to such damage.

The magnitude of and variation in the thicknesses of the chips is of primary importance to digester yield, while variation in the lengths of the chips is less important and the magnitude of and variation in the widths of the chips is generally considered to have minor or negligible importance.

The defining characteristic of chipper equipment is that it is adapted to cut wood mainly across the grain. The chips so produced have a length that is relatively well controlled by the depth of penetration of the knife into the wood. On the other hand, they have a thickness and width that are not well controlled. The thickness, particularly, depends on a number of factors, including the type of wood and its moisture content, whether the wood is frozen, and the cutting geometry. Chip thickness can be controlled somewhat by controlling chip length; however, the resulting chips are distributed about the desired mean chip thickness so that a large number of the chips exceed the tolerable range. Accordingly, an expensive and inefficient process of sorting reject chips and reworking them into an acceptable form is required.

Another type of equipment, known as the waferizer or strander, has been employed to produce wafers, strands or flakes of wood ("flakes") for the production of waferboard or oriented strand board ("OSB"). The waferizer is similar in principle to the chipper, except that it cuts the wood substantially parallel to the grain to produce flakes having a very small thickness, e.g., about 0.025", and relatively long lengths of about 4" to 5". In the waferizer, the thickness corresponds to the amount the apparatus cuts into the wood. Since this is a relatively small amount in the waferizer in comparison with the chipper, the waferizer is provided with a relatively low power so that practical examples are inadequate for producing chips for pulp.

Accordingly, there is a need for a chip and method for the production of wood pulp that optimizes digester yield and, accordingly, the yield and efficiency of the entire pulping process, by improving control of variations in the width and length of the chips, and by optimizing the shape of the chips.

SUMMARY OF THE INVENTION

A chip and method for producing wood pulp according to the present invention solves the aforementioned problems and meets the aforementioned needs by forming first, second and third pairs of substantially parallel sides by cleaving, cutting and cutting, respectively. In one aspect of the invention, the second pair of sides are cut by a first knife to be spaced between about 2 to 8 mm for consistency with industry standards. The third pair of sides are cut by a second knife so as to be spaced a greater distance apart than the first pair. The first pair of sides are cleaved substantially along the grain direction so as to be spaced also a greater distance apart than the first pair.

In another aspect of the invention, the third pair of sides is cut so as to be substantially perpendicular to the first pair of sides.

Preferably, the chips so produced have a predetermined length determined by the spacing between pairs of scoring knives adapted for cutting the wood against the grain to form end surfaces that are perpendicular to main surfaces defined as having the largest area.

Therefore, it is a principal object of the present invention to provide a novel and improved chip and method for producing wood pulp.

It is another object of the present invention to provide such a chip and method that increases the rate of production of cellulose.

It is yet another object of the present invention to provide such a chip and method that increases the rate of production of cellulose in a digester.

It is still another object of the present invention to provide such a chip and method that provides for improved control of the dimensions of the chip that are most important to the rate of production of cellulose in the digester.

It is a further object of the present invention to provide such a chip and method that provides for improved packing of a number of the chips in the digester.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
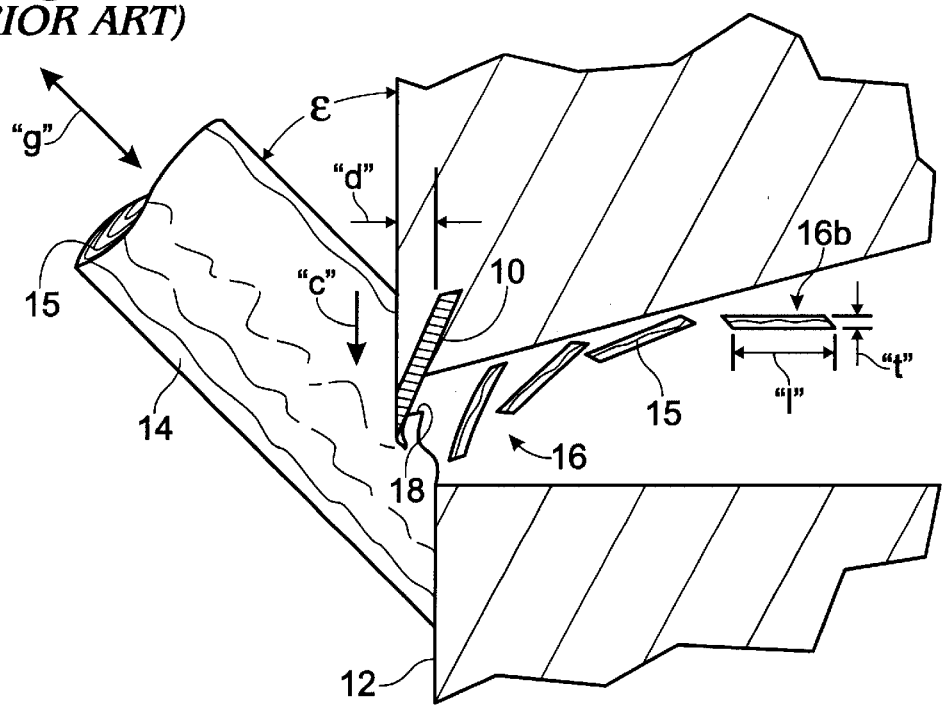
Fig. 1 (PRIOR ART)
FIG. 1 is a cross-sectional view of a prior art chipper apparatus.

In FIG. 1, prior art chipper cutting apparatus is shown in cross-section. The cutting apparatus includes a knife 10 that extends beyond a work surface 12 a predetermined amount "d". An bulk article of wood 14, such as a log, board or plank is placed against the work surface 12 and extends at a feed angle $\epsilon$ from the work surface, typically about 30–40 degrees. The wood has a grain direction "g" running along the elongate axis thereof. The grain direction indicates the alignment direction of elongate cellulose fibers 15 in the wood which it is ultimately desired to extract intact. Cutting "parallel to the grain," is defined hereinafter as cutting in a plane so as to substantially separate the fibers from one another without substantially cutting across the fibers, i.e, a plane that includes lines parallel to the grain direction "g". Cleaving is then, by definition, "parallel to the grain."

As the knife 10 is moved with respect to the wood 14 in a cutting direction "c", a sequence of chips 16 are cut from the wood. The chips have a thickness "t" and a length "l" with a width "w" (not shown) that extends perpendicular to the plane of the figure.

The length "l" is primarily determined by the depth of penetration "d" of the knife into the wood. This is typically about ¾" for chips employed for producing cellulose or wood pulp. Ends 18 of the chips are deformed and bruised during the cutting, so that they do not always return to their sharp angled configuration idealized at 16*b*. Even where the ends do return to their sharp angled configuration, they have greater susceptibility to damage during subsequent packaging, handling and processing than do square ends.

The thickness "t" of the chips is determined primarily by the ratio of the shear strength to the cleavage strength of the wood. This is partially a function of the length of the chip, but also varies substantially depending on the type of wood and its condition, e.g, its moisture content and whether it is frozen. Typically, the length of the chip is adjusted so that the thickness "t" of a large number of the chips 16 varies in a bell-shaped or normal distribution about a mean of about 4–5 mm, which as has been mentioned is considered optimum. However, the standard deviation of the distribution is large enough so that only about 85–90% of the chips fall within the acceptable industry standard range of between about 2 to 8 mm.

Figure 2:
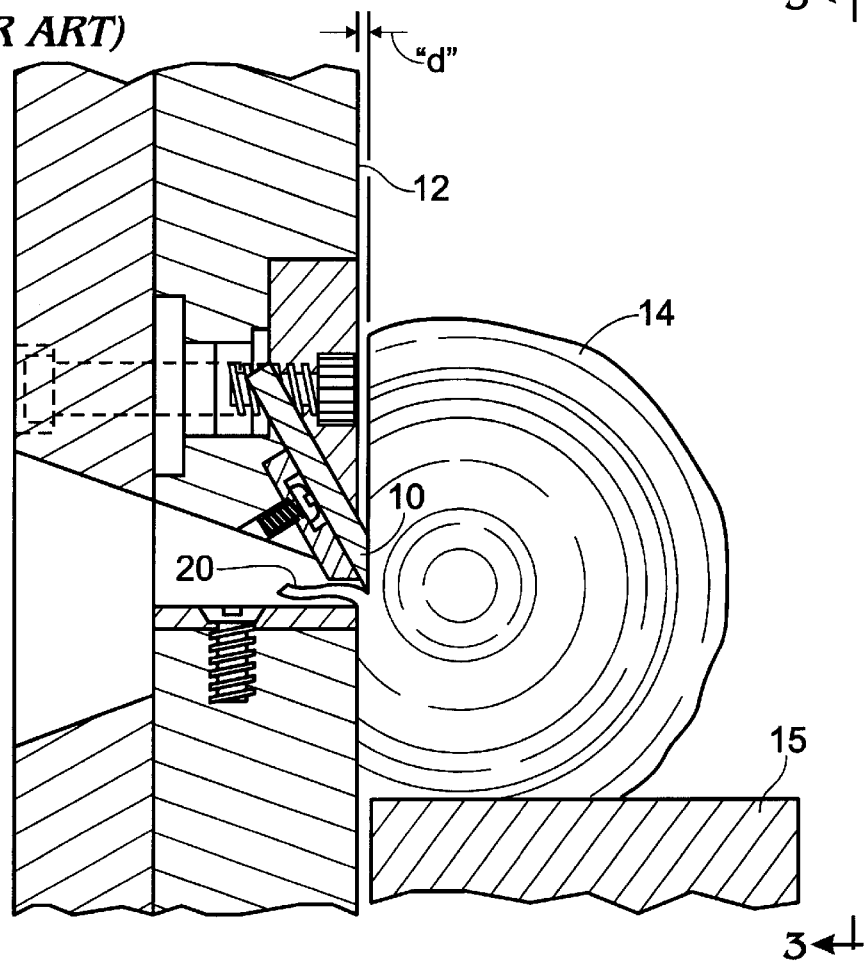
Fig. 2 (PRIOR ART)
FIG. 2 is a cross-sectional view of a prior art waferizer apparatus.

Turning to FIG. 2, a prior art waferizer is shown. The waferizer is similar in principle to the chipper, except that the wood 14 is placed against the work surface 12 at a feed angle $\epsilon$ of about 0 degrees, so that the knife 10 cuts the wood substantially parallel to the grain to produce flakes 20. This change in the feed angle of the wood provides for substantial and important differences in the dependencies of the length and thickness dimensions of the flake. Particularly, now the thickness "t," instead of the length "l," is determined by the distance that the knife extends beyond the work surface.

Flakes produced in typical waferizers have a thickness of about 0.025". This corresponds as aforementioned to the amount the knife 10 cuts into the wood 14. As the desired pulp chip thickness is about 6–8 times larger, the power required to produce the flake is roughly about 6–8 times less than the power required to produce the pulp chip.

According to the present invention, the knife 10 is adapted to cut the wood 14 substantially parallel to the grain as described below. This is preferably accomplished by employing a waferizer, but may be accomplished using any other suitable apparatus.

Figure 3:
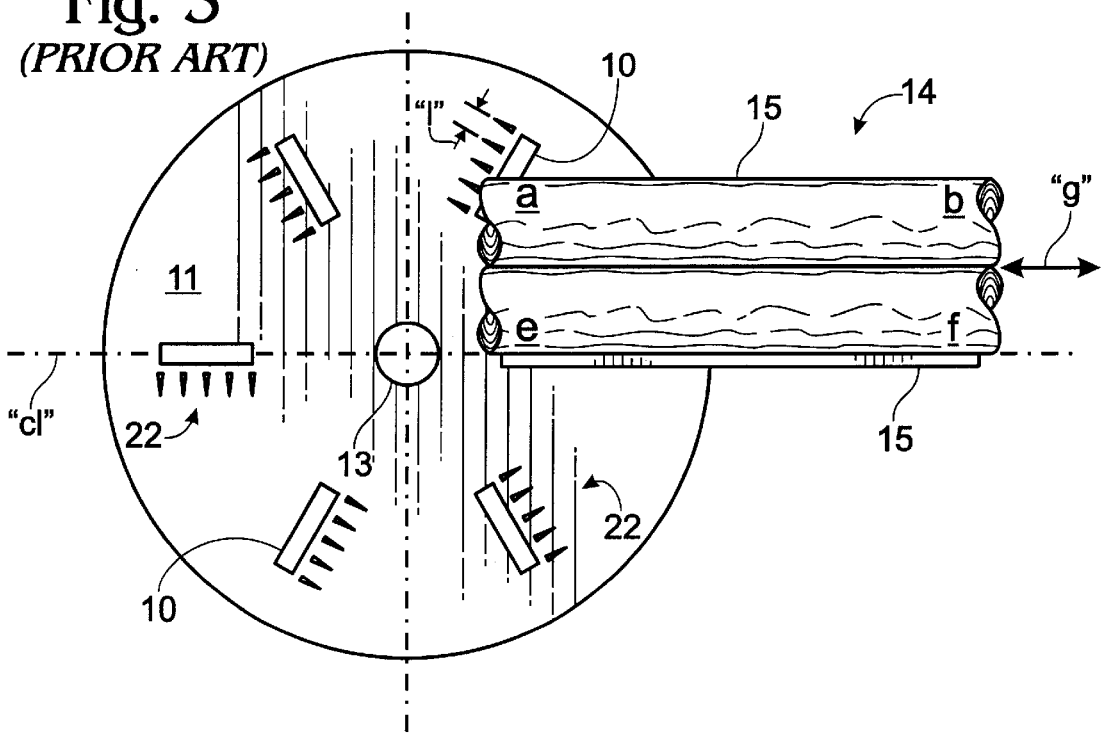
Fig. 3 (PRIOR ART)
FIG. 3 is an elevational view of the waferizer of FIG. 2, taken along a line 3—3 thereof.

Referring to FIG. 3, in the preferred waferizer embodiment of the invention, a number of the knives 10 are disposed radially on a chipper disc 11, extending out of the plane of the disc. The disc rotates about a center shaft 13. A feed trough 17 is disposed horizontally and extends along the center-line "cl" of the disc 11. The feed trough supports, typically, a vertical stack of the wood 14 wherein the grain direction "g" lies parallel to the trough. The knives 10 are rotated against and into the sides of the wood 14, making various angles with respect to the horizontal and the grain direction "g", depending on the elevation of the wood above the table 15. However, it can be seen that the knives 10 always cut substantially parallel to the grain, i.e., as discussed above, so as to separate the parallel fibers 15 forming the grain rather than to cut across them. This cutting characteristic decreases damage to the fibers.

An outstanding advantage of the invention is that it provides for exceptional control of the critical thickness dimension of the chips. Referring back to FIG. 2, the knife 10 is adapted to project beyond the work surface 14 a distance "d" about equal to the thickness "t" of the chip 16 produced thereby. This produces a cut in the wood that has a depth that is very closely equal to the thickness "t." Thickness variation is, to a practical degree, virtually eliminated.

Referring to FIG. 3, the length dimension is, in addition to the thickness, also highly controlled by employing spaced serrations or scoring knives 22 either upstream or downstream of the knife 10. A distance "l" between the scoring knives establishes the length "l" of the flake. The scoring knives are adapted for cutting along lines perpendicular to the cut made by the knife 10 and are provided at "l" spaced intervals.

Figure 4:
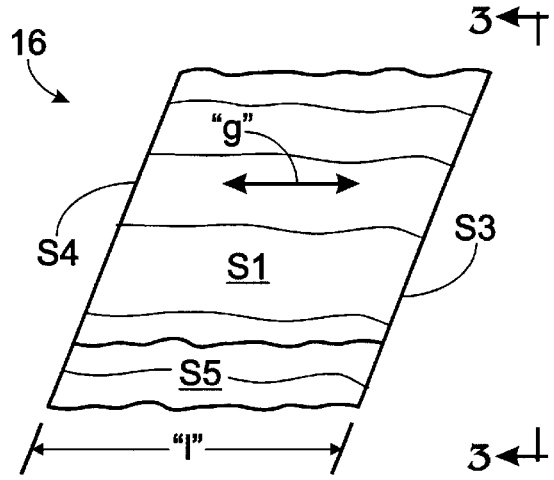
FIG. 4 is a plan view of a chip according to the present invention.
Figure 5:
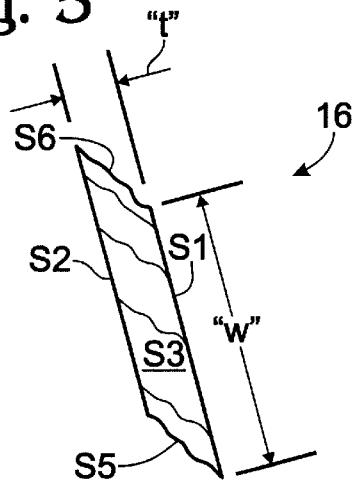
FIG. 5 is a side elevation of the chip of FIG. 4, taken along a line 5—5 thereof.
Figure 2:
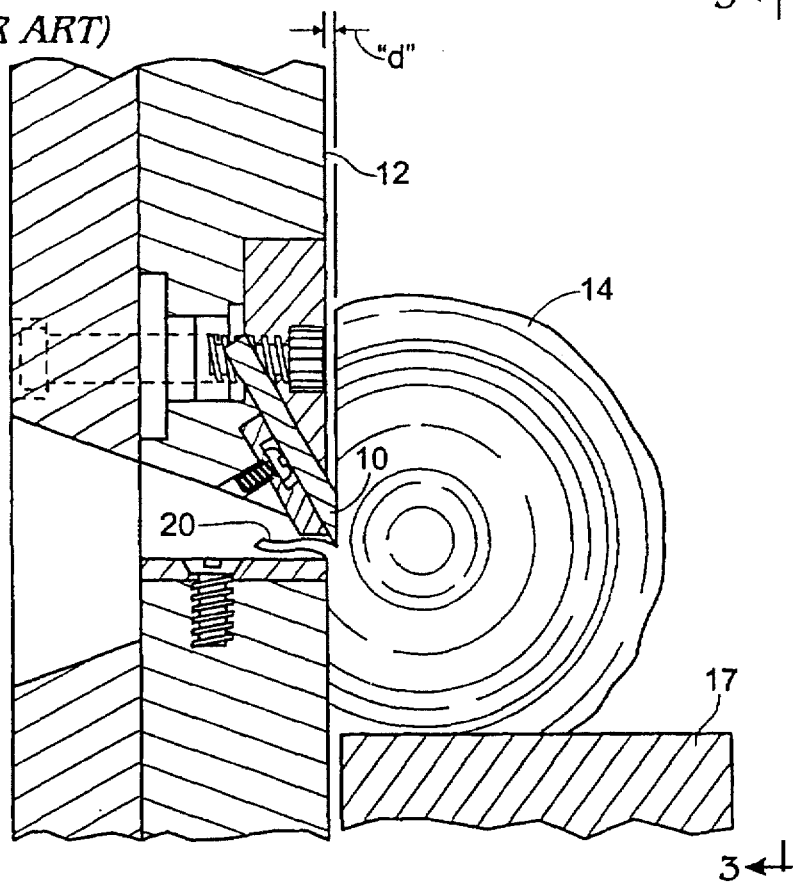
Fig. 2 (PRIOR ART)
Figure 3:
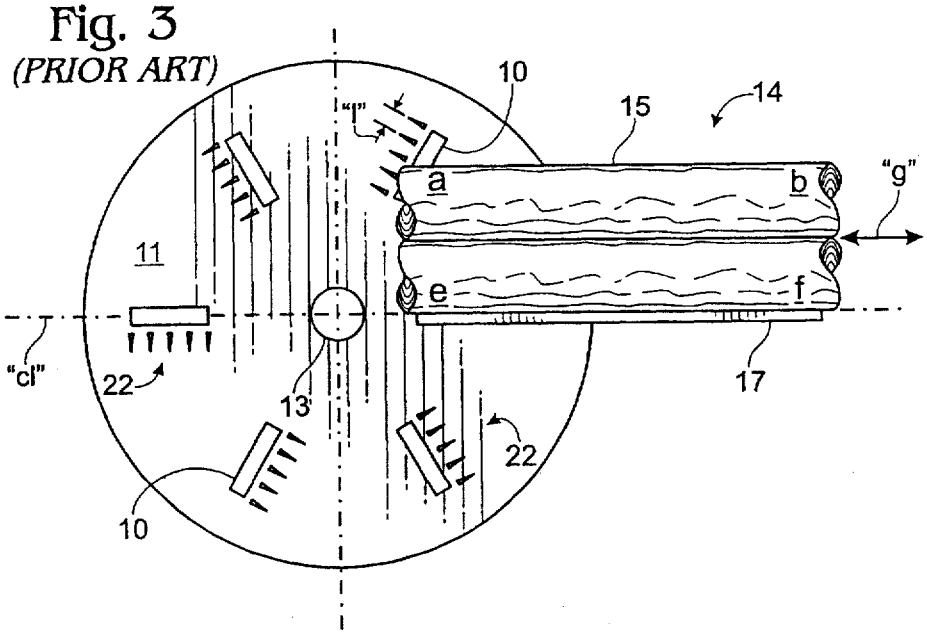
Fig. 3 (PRIOR ART)
Figure 4:
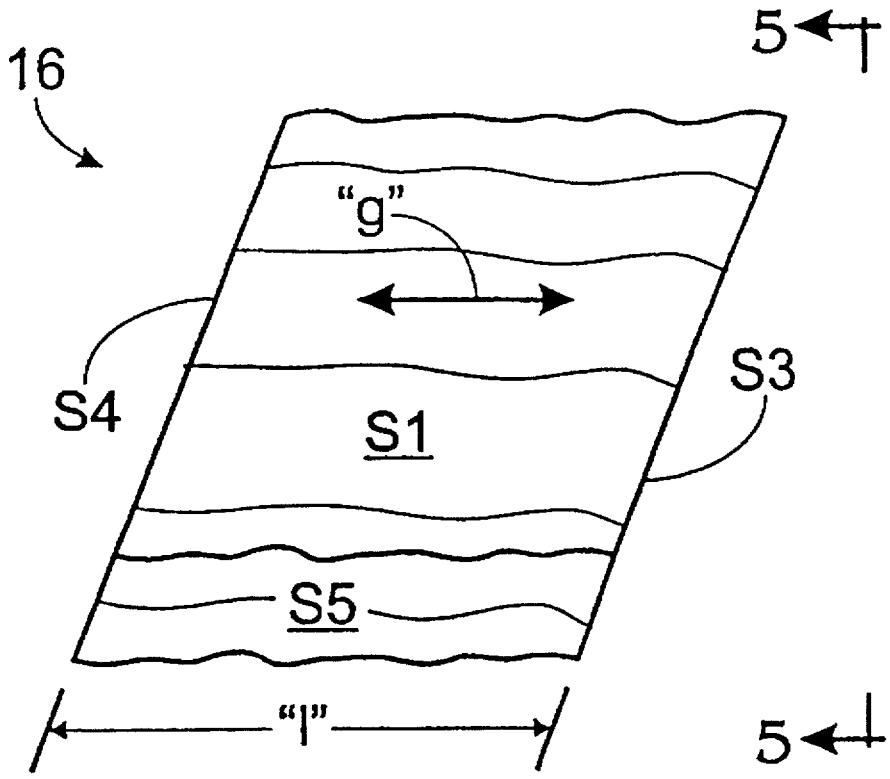
Figure 3:
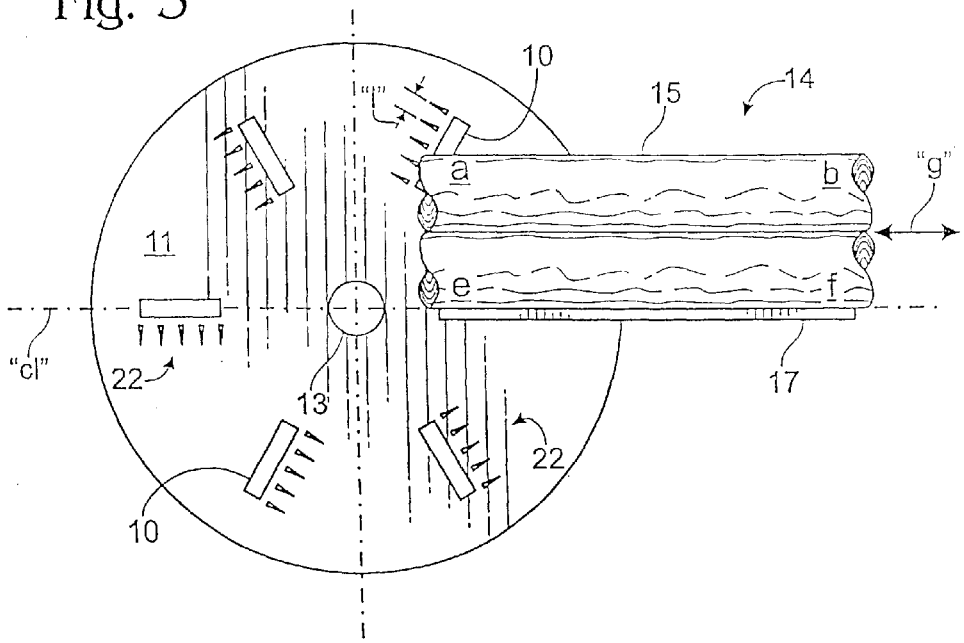

Referring to FIGS. 4 and 5, a chip 16 produced according to the present invention is shown. The shape of the chip varies from rhombohedral (as illustrated) to orthorhombic depending on the originating location of the chip within the wood 14. Referring back to FIG. 3, this consideration is illustrated in one dimension where it will be understood that a similar consideration applies to the orthogonal dimension. In FIG. 3, two articles of wood 14, shown as two logs, one on top of the other, rest on the work surface 12. The articles of wood are forced against the disc 11, as indicated in FIG.

2. As the disc rotates about the center shaft 13, the knives 10 cut into the sides of the articles of wood. Because of the angle each knife makes with the grain direction "g", however, chips cleaved from the wood at location "a" in FIG. 3 are more rhombohedral than chips cleaved at location "b." On the other hand, chips formed at either locations "e" or "f" are nearly orthorhombic because knives 10 are nearly aligned with the center line "cl."

Returning to FIGS. 4 and 5, the chip 16 has six sides "s1"–"s6" which can be identified as three pairs of substantially parallel sides. The knife 10 cuts the large sides "s1" and "2" defined by the length and width dimensions "l" and "w" respectively. The scoring knives 22 cut the sides "s3" and "s4" across the width and thickness dimension "t." The surface texture of the sides "s1"–"s4" may show some cleavage but, primarily, is relatively smooth as a result of the cutting or scoring. The sides "s3" and "s4" are particularly smooth, as they are cut across the grain. The remaining sides "s5" and "s6" are cleaved by breaking, by means well known in the art which are not particularly pertinent to the invention and need not be described. However, it should be noted that, in breaking the sides "s5" and "s6", the wood cleaves along the grain direction "g" so that the wood fibers are relatively undamaged, the surface texture of the sides therefore being relatively irregular as compared to the sides "s1"–"s4."

Because the knives 10 are mounted on the circular disc 11, the sides "s3" and "s4," cut by the scoring knives 22, vary from being perpendicular to the grain direction "g" to being at an acute angle with respect to the grain direction "g". However, the sides "s1" and "s2" are of minimum area with respect to a given thickness "t", i.e., they are perpendicular to the sides "s1" and "s2." This provides advantages over the chip geometry proposed in Altosaar, for example, where the corresponding sides form acute and obtuse angles. A first advantage is that the invention desirably minimizes the area over which damage to wood fibers by cutting can occur. This is especially important for chips wherein the fibers are cross-cut at angles so that greater portions of thereof are susceptible to damage. An additional advantage is that, as mentioned above, the square corners provided in the present invention are stronger than corners formed as acute angles; therefore, the chips are less susceptible to damage during subsequent packaging, handling and processing.

The variability in chip thickness that has heretofore been encountered in prior art methods for forming chips for pulping is substantially eliminated by providing that the knife 10 cuts the thickness directly. In addition, variability in the length of the chips is maintained at or below prior art levels by employing the scoring knives 22. The degree of dimensional control afforded by the method is believed to provide for about a 30% increase in the yield of usable cellulose fiber from the digester.

It is to be recognized that, while a specific chip and method for producing wood pulp has been shown and described as preferred, other configurations could be utilized, in addition to configurations already mentioned, without departing from the principles of the invention. For example, while a waferizer embodiment has been employed for illustrating the invention and many of the considerations discussed herein are specifically applicable thereto, other suitable apparatus may be employed to form the chip and may involve other considerations, advantages and disadvantages without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A method for forming a wood chip for the production of cellulose pulp, the chip having a grain extending along a grain direction, the chip having first, second and third adjoining sides, the method comprising:

cleaving the chip along the grain direction to form the first side;

cutting the chip to form the second side;

cutting the chip to form the third side so that the third side is substantially perpendicular to the second side;

cutting the chip to form a fourth side substantially parallel to the second side and spaced therefrom between about 2 to 8 mm;

cutting the chip to form a fifth side substantially parallel to the third side and spaced therefrom a substantially greater distance than the fourth side is spaced from the second side; and cleaving the chip to form a sixth side substantially parallel to the first side and spaced therefrom a substantially greater distance than the fourth side is spaced from the second side.

2. The method of claim 1, wherein said cutting the chip to form the second side is by a first knife and said cutting the chip to form the third side is by a second knife.

3. The method of claim 2, wherein said cutting the chip to form said fourth side is by said first knife.

4. The method of claim 3, wherein said cutting the chip to form said fifth side is by a third knife spaced from said second knife.

5. The method of claim 1, wherein said cutting the chip to form the second side is by a first knife and said cutting the chip to form the third side is by a second knife.

6. The method of claim 5, wherein said cutting the chip to form said fourth side is by said first knife.

7. The method of claim 6, wherein said cutting the chip to form said fifth side is by a third knife spaced from said second knife.

8. A chip for use in the production of wood pulp, the chip comprising a grain extending along a grain direction and three pairs of substantially parallel sides, wherein the sides of a first pair of sides are spaced apart a distance of about 2 to 8 mm, wherein the sides of said second and third pairs of sides are spaced apart by substantially greater amounts than said sides of said first pair, and wherein said sides of said second pair of sides are substantially perpendicular to said sides of said third pair of sides.

9. The chip of claim 8, wherein said second pair of sides has a relatively irregular surface substantially aligned with said grain direction, wherein said first and third pairs of sides are relatively smooth compared to said first pair of sides.

10. The chip of claim 9, wherein said sides of said third pair of sides are relatively smooth compared to said sides of said first pair.

* * * * *

UNITED STATES PATENT AND TRADEMARK OFFICE

CERTIFICATE OF CORRECTION

PATENT NO. : 6,267,164 B1
DATED : July 31, 2001
INVENTOR(S) : Charles Thomas Carpenter It is certified that error appears in the above-identified patent and that said Letters Patent is hereby corrected as shown below:

Drawings,
Replace Figure 2 of the issued patent with the Figure 2 on attached page.
Replace Figure 3 of the issued patent with the Figure 3 on attached page.
Replace Figure 4 of the issued patent with the Figure 4 on attached page.

Signed and Sealed this

Twenty-third Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,267,164 B1
DATED : July 31, 2001
INVENTOR(S) : Charles Thomas Carpenter It is certified that error appears in the above-identified patent and that said Letters Patent is hereby corrected as shown below:

Drawings,
Replace Figure 3 of the issued patent with the Figure 3 attached herewith:

Column 5,
Line 31, “s1” should read -- s3 -- and “s2” should read -- s4 --.

Column 6,
Line 55, “second” should read -- first --.
Line 60, “first” should read -- second --.

Signed and Sealed this

Twentieth Day of January, 2004

JON W. DUDAS
*Acting Director of the United States Patent and Trademark Office*